United States Patent [19]

Osrow

[11] Patent Number: 4,496,826

[45] Date of Patent: Jan. 29, 1985

[54] HAND-HELD SHOCK-RESISTANT ELECTROLYTICALLY HEATED STEAM PRODUCING APPARATUS

[76] Inventor: Leonard Osrow, 180 S. Middleneck Rd., Great Neck, N.Y. 11021

[21] Appl. No.: 466,216

[22] Filed: Feb. 14, 1983

[51] Int. Cl.[3] ..... H05B 3/60; H05B 1/02; D06F 75/16; F22B 1/30

[52] U.S. Cl. ..... 219/272; 38/69; 38/77.82; 68/222; 219/245; 219/275; 219/284; 219/295; 239/136

[58] Field of Search ..... 38/77.5, 77.7, 77.8, 38/77.82, 69; 219/271–276, 362, 284–295, 245; 68/222; 128/203.17, 203.27, 367, 368; 239/133, 135, 136; 4/535–537; 261/141, 142

[56] References Cited

U.S. PATENT DOCUMENTS

| | | | |
|---|---|---|---|
| 3,617,698 | 11/1971 | Duncanson | 219/290 X |
| 3,745,306 | 7/1973 | Naritomi | 219/295 X |
| 3,755,649 | 8/1973 | Osrow | 219/288 X |
| 3,969,607 | 7/1976 | Osrow et al. | 219/295 X |
| 3,997,759 | 12/1976 | Osrow et al. | 219/295 X |
| 4,206,340 | 6/1980 | Osrow et al. | 219/295 X |
| 4,366,367 | 12/1982 | Mazzucco | 219/295 X |

FOREIGN PATENT DOCUMENTS

| | | | |
|---|---|---|---|
| 469253 | 2/1952 | Italy | 38/77.82 |
| 801790 | 2/1981 | South Africa | 219/284 |
| 474204 | 10/1937 | United Kingdom | 38/77.82 |
| 484974 | 5/1938 | United Kingdom | 38/77.82 |

*Primary Examiner*—A. Bartis

*Attorney, Agent, or Firm*—Kirschstein, Kirschstein, Ottinger & Israel

[57] ABSTRACT

A hand-held electrolytically heated steam producing apparatus, e.g., steaming iron, includes a hollow housing having an interior subdivided by a partition wall into a pair of compartments communicated by a passage. A first compartment accomodates a pair of spaced electrodes that are at different electrical potentials during steam-producing operations of the apparatus, while the second compartment is penetrated by a tubular stack extending from a steam outlet in the bottom wall of the housing to a given distance from the top wall of the housing but below the level of the passage. The top wall of the second compartment is also provided with a water inlet offset from the steam stack and equipped with a removable closure. To prevent the formation of an electrically conductive path through the water between the electrodes and the user in all positions of the apparatus, the partition wall is L-shaped in vertical cross section to define a recess below the passage open to the first compartment and sized to retentively receive substantially all of the water contents of the first compartment when the housing is in an up-ended position with the first compartment above the second compartment, thereby preventing water from flowing between the compartment and forming an electrically conductive path. The apparatus includes a switch for controlling the energization of the electrodes and an interlock arrangement between the inlet closure and switch prevents removal of the closure if the electrodes are energized and the energization of the electrodes if the closure is removed to fill the apparatus.

12 Claims, 11 Drawing Figures

FIG. 5
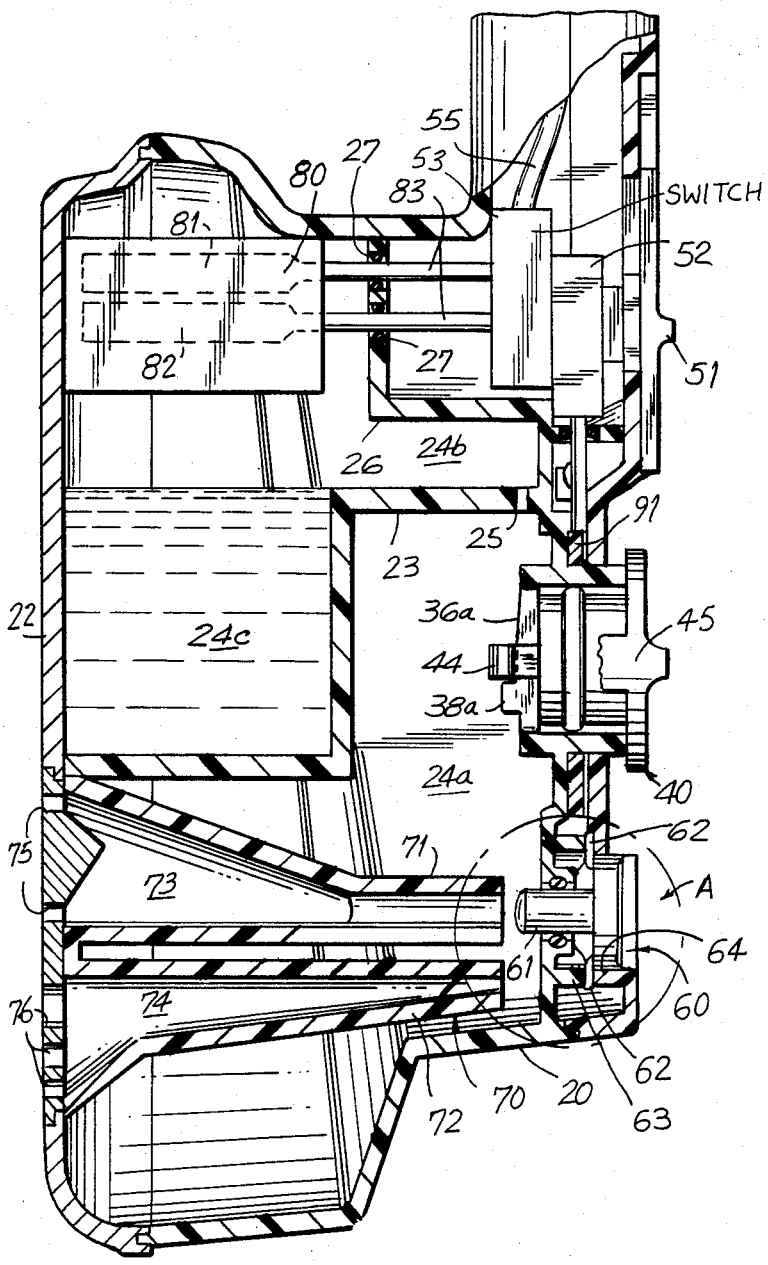
FIG. 6
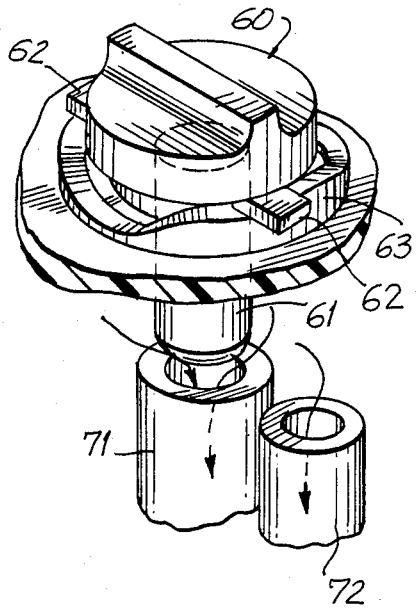
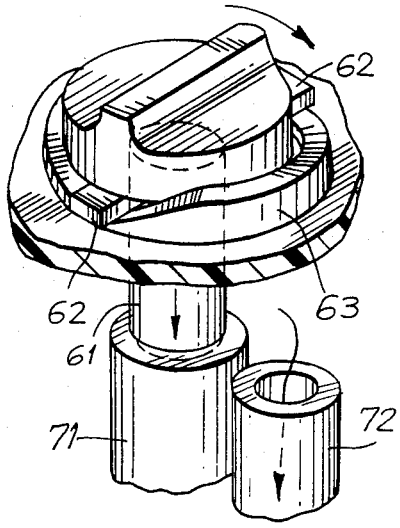
FIG. 7

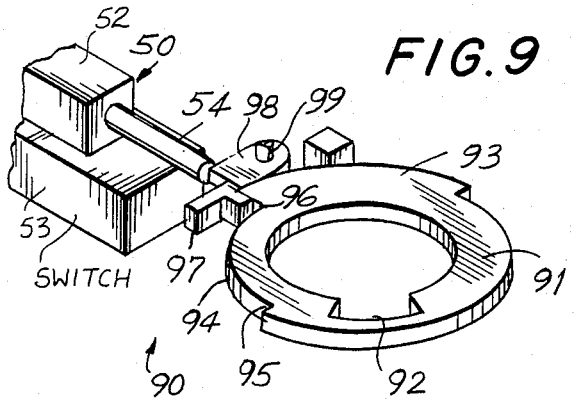
FIG. 9
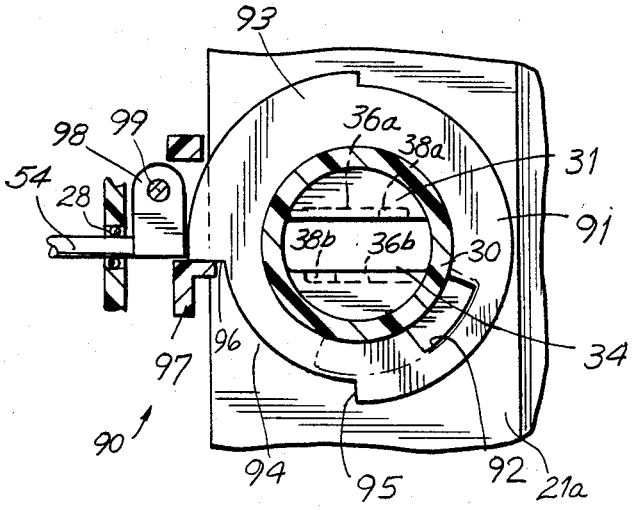
FIG. 10
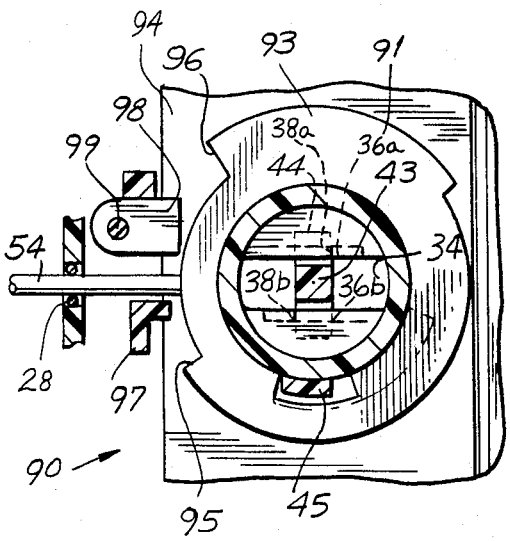
FIG. 11
FIG. 8
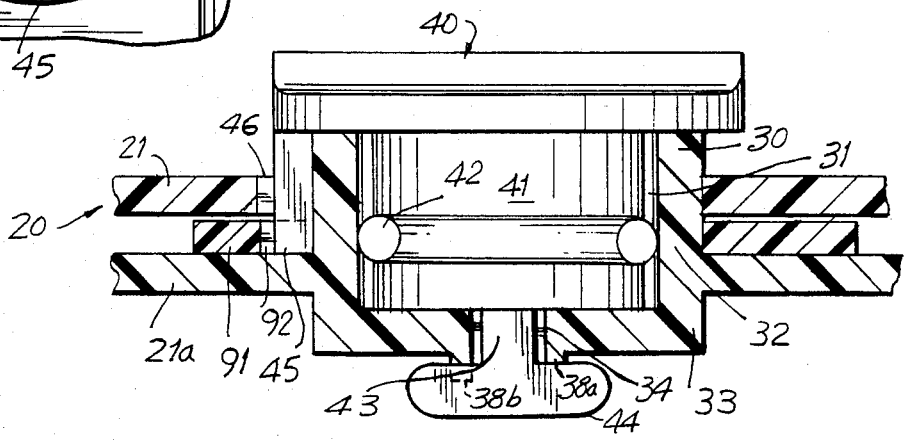

HAND-HELD SHOCK-RESISTANT ELECTROLYTICALLY HEATED STEAM PRODUCING APPARATUS

The present invention relates to hand-held steam-producing devices in general, and more particularly, to steaming irons which are resistant to electrical shock.

Users of steam irons of the type disclosed in U.S. Pat. No. 4,206,309 could be exposed to the danger of electrical shock, especially during the filling operation, particularly if the iron is handled improperly after damage has occurred to the steam-producing electrodes or the electrical switch for energizing the latter. This danger, as minimal as it may be, is usually unacceptable.

Accordingly, it is a general object of the present invention to so construct the apparatus of the type here under consideration as to eliminate the danger of electric shock to the user of the apparatus under all circumstances.

Yet another object of the present invention is so to design the apparatus of the above type as to avoid improper handling of the apparatus which could expose the user to the danger of electric shock.

In pursuance of these objects and others which will become apparent hereafter, one feature of the present invention resides, in a hand-held steam-producing apparatus, particularly in a steaming iron, of the type including a housing having an interior which is subdivided by a partitioning wall into two communicating compartments, one of which accommodates a steam-producing device including at least two spacedly juxtaposed electrodes that are at different electric potentials during the steam-producing operation of the apparatus, while the other compartment is penetrated by at least one tubular stack extending from at least one outlet port passing through a bottom wall to a given distance from a top wall of the housing as considered in a filling position of the apparatus, and wherein the top wall of the housing is provided upwardly of the other compartment and at an offset from the steam stack with a filling opening equipped with a closure, in the improvement comprising means for preventing formation of an electrically conductive path through water between the steam-producing device and the user in all positions of the apparatus. A particularly advantageous construction is obtained when the preventing means includes a water-impervious and electrically insulating part of the partitioning wall which reaches from the bottom wall to a level above the steam stack to prevent water from flowing between the compartments and forming the electrically conductive path in the filling position of the apparatus.

The novel features which are considered as characteristic of the invention are set forth in particular in the appended claims. The improved steaming iron or similar hand-held steam-producing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 5 is a view similar to FIG. 3 but in an up-ended position of the steaming iron;

FIG. 6 is a perspective view of a detail A of FIG. 5 in an open position;

FIG. 7 is a view similar to FIG. 6 but in a closed position;

FIG. 8 is a sectional view of a detail taken along line 8—8 of FIG. 3;

FIG. 9 is a perspective view of certain components of the detailed view of FIG. 8;

FIG. 10 is a sectional view taken along line 10—10 of FIG. 2 showing certain components in a locking position; and FIG. 11 is a view similar to FIG. 10 but in an unlocking position.

DETAILED DESCRIPTION OF THE PREFERRED EMBODIMENT

Figure 1:
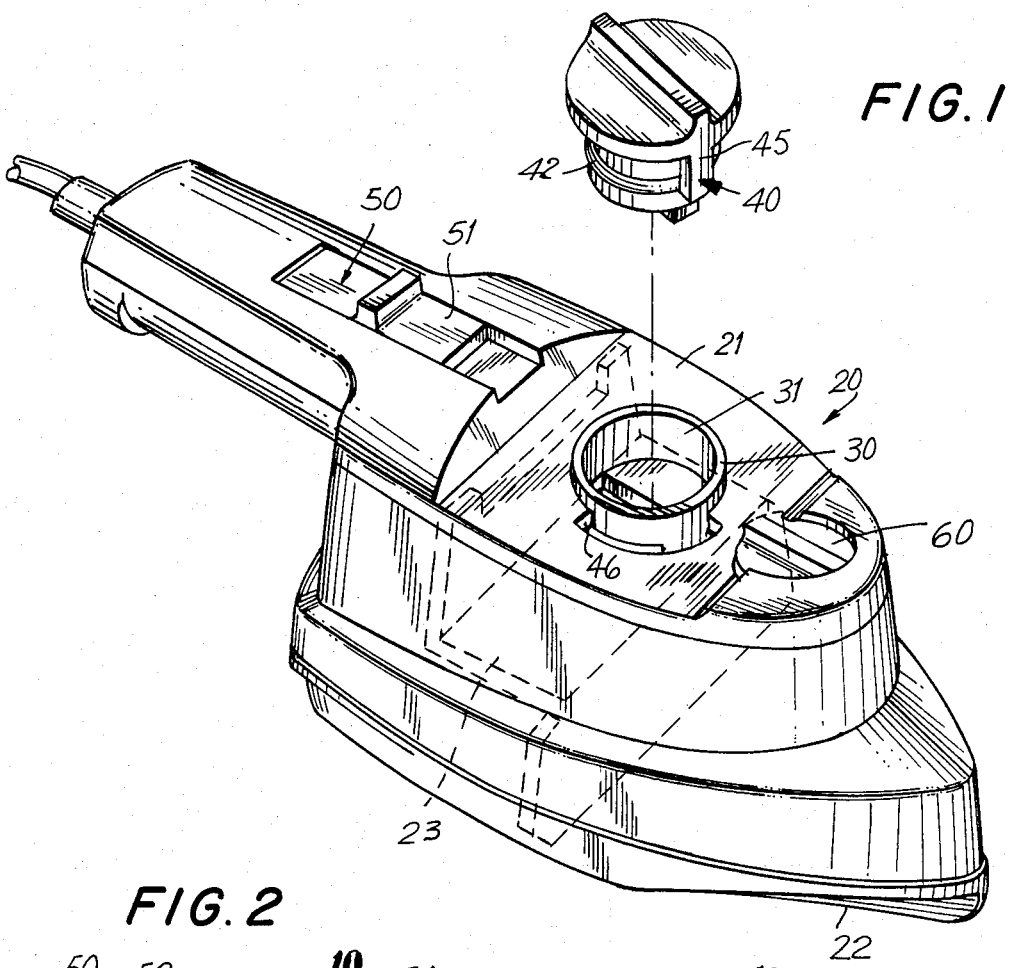
FIG. 1 is a perspective view of a steaming iron embodying the present invention.
Figure 2:
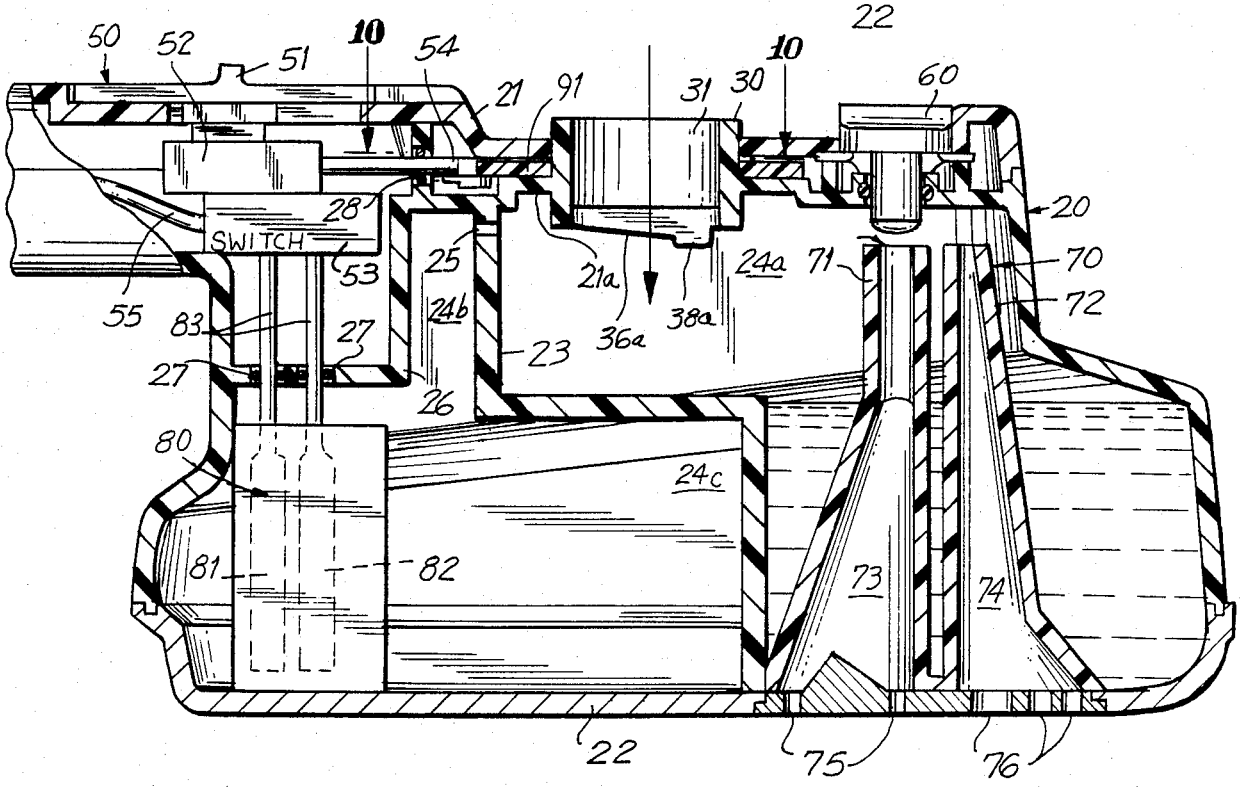
FIG. 2 is a front-to-rear sectional view of the steaming iron of FIG. 1 with a closure removed.

Referring now to the drawing in detail, and first to FIG. 1 and FIG. 2 thereof, it may be seen that the reference numeral 20 has been used to identify a housing of a steam-producing device, especially a hand-held or so-called travel steaming iron. The housing includes a cover wall 21, a top wall 21*a* and a bottom wall 22. A tubular projection 30 is provided on the top wall 21*a*, preferably integrally therewith, the projection 30 extending through an opening in the cover wall 21 and bounding a filling opening 31. The filling opening 31 is closable by a plug 40 which constitutes a closure for the filling opening.

An electrical switch 50 including an actuating member 51 shiftable between its illustrated off position and an on position is mounted on the cover wall 21 of the housing 20 at a position and in an orientation relative to the filling opening 31 which will be discussed in detail later. Also mounted on the cover wall 21 of the housing 20 is a closing member 60 whose purpose will also be explained later. FIG. 1 also shows, in broken lines seen present within the housing 20, a partitioning wall 23.

As may be seen in FIG. 1 and also in FIG. 2, the partitioning wall 23 has a generally bench-shaped configuration, and it subdivides the interior of the housing 20 into two compartments 24*a* and 24*b* shown particularly in FIG. 2, in which the steaming iron or similar steam-producing apparatus is shown in its filling position. In this position, and with the closure or plug 40 removed from the filling opening 31, water can be poured through the filling opening 31 into the interior of the housing 20. Since the filling opening 31 is situated above the compartment 24*a*, the water will first enter the latter, and the water level in the compartment 24*a* will thus rise.

The compartment 24*a* is penetrated, from the bottom wall 22 to a predetermined, relatively short, distance from the top wall 21*a*, by a steam stack arrangement 70. As illustrated in the drawing, the steam stack arrangement 70 includes two steam stacks 71 and 72 which have tubular configurations, thus bounding respective steam passages or flues 73 and 74. The flues 73 and 74 respectively communicate with outlet ports 75 and 76 which penetrate through the bottom wall 22.

The respectively other compartment 24*b* accommodates a steam-producing device 80 which is preferably of the type disclosed in the above-mentioned U.S. Pat. No. 4,206,340 and which includes at least two spacedly juxtaposed electrodes 81 and 82 that are at different electric potentials during the steam-producing operation of the device 80.

It may be seen that the partitioning wall 23 rises to a level above the upper ends of the steam stacks 71 and 72 and that it forms a passage 25 communicating the two compartments 24*a* and 24*b* well above the level of the steam stacks 71 and 72 as considered in the illustrated filling position. The partitioning wall 23 in accordance with the present invention is imperforate up to the level of the passage 25 and is made of an electrically insulating material, as is the remainder of the housing 20. Thus, during the filling operation, the water level in the compartment 24*a* will rise, while the partitioning wall 23 will prevent water from flowing from the compartment 24*a* into the compartment 24*b* and thus from reaching the steam-producing device 80. In this manner, it is prevented that an electrically conductive path could be formed through water between the steam-producing device 80 and the user pouring the water into the filling opening 31.

Usually, the user will know the capacity of the compartment 24*a* and attempt to pour only so much water into the filling opening 31 as not to overfill the compartment 24*a*. However, it can sometimes happen that, for instance, due to lack of attention or ignorance on the part of the user, more water than the compartment 24*a* can accommodate can be poured into the opening 31. Under these overfilling conditions, it must also be assured that no water will flow through the passage 25 into the compartment 24*b* so that the danger of formation of the aforementioned electrically conductive path is avoided even under these circumstances. For this reason, the steam stacks 71 and 72, or at least one of them, terminate, as mentioned before, at a lower level than the passage 25 in the partitioning wall, so that any excess quantity of water poured into the compartment 24*a* will escape through the passages 73 and 74 of the steam stacks and the outlet ports 75 and 76 of the bottom wall 22, without raising the level of water in the compartment 24*a* to or above the lowest region of the passage 25 where the water could then overflow into the compartment 24*b*, with the above-discussed undesirable consequences. Of course, once the water starts dripping or streaming out of the outlet ports 75 and 76, the user will usually become aware of the overfilling condition and will stop pouring water into the filling opening 31.

FIG. 2 also shows that the switch 50 further includes an operating element 52 which is connected to the actuating member 51 and which is mounted on a switch base or housing 53 for movement with the actuating member 51 between the on and off positions thereof. In FIG. 2, the operating element 52 is shown to be in its off position, as it should be during the filling operation to further reduce the danger of electric shock. However, since it cannot be assured that the user will always make sure that the switch 50 is turned off before starting pouring water into the interior of the housing 20, the apparatus of the present invention is further provided with a cam arrangement 90 which will be described in detail later and which serves the purpose of making sure that the switch 50 cannot be turned on while the closure 40 is removed and that the closure 40 cannot be removed unless the switch 50 is in its off position.

Electric current is supplied to the switch 50 through an electric cable 55. The steam-producing or heating device 80 has electric leads 83 which connect the respective electrodes 81 and 82 with the switch 50. In order to protect the user from the danger of electric shock, and the switch 50 and the electric conductors connected thereto from corrosion, it is desirable to separate this area from the remainder of the interior of the housing 20. For this purpose, there is provided a compartmentalizing wall 26 which surrounds the region at which the switch 50 is located and which is impermeable to water except for having respective openings for the passage of the electric leads 83 and of a substantially pin-shaped portion 54 of the operating element 52 therethrough. The leads 83 are sealed in their respective openings by seals, especially O-rings 27,27 while the pin-shaped portion 54 of the operating element 52 is sealed in its opening by a seal 28 which may also be constituted by an O-ring or any other appropriate shaft seal.

After the compartment 24*a* has been filled with water and the closure 40 has been inserted into the opening 31 and turned and locked therein to assume its closing or retained position in which it water-tightly closes the filling opening 31, the water present in the compartment 24*a* can be transferred into the compartment 24*b*. To achieve this, the apparatus is tilted into its one up-ended position in which the compartment 24*a* is situated above the compartment 24*b*, so that the water present in the compartment 24*a* can flow through the passage 25 past the partition 23 into the compartment 24*b*. The capacity of the compartment 24*b* is such that the entire water contents of the compartment 24*a* can be and is accommodated in the compartment 24*b* after transfer from the compartment 24*a*.

Figure 3:
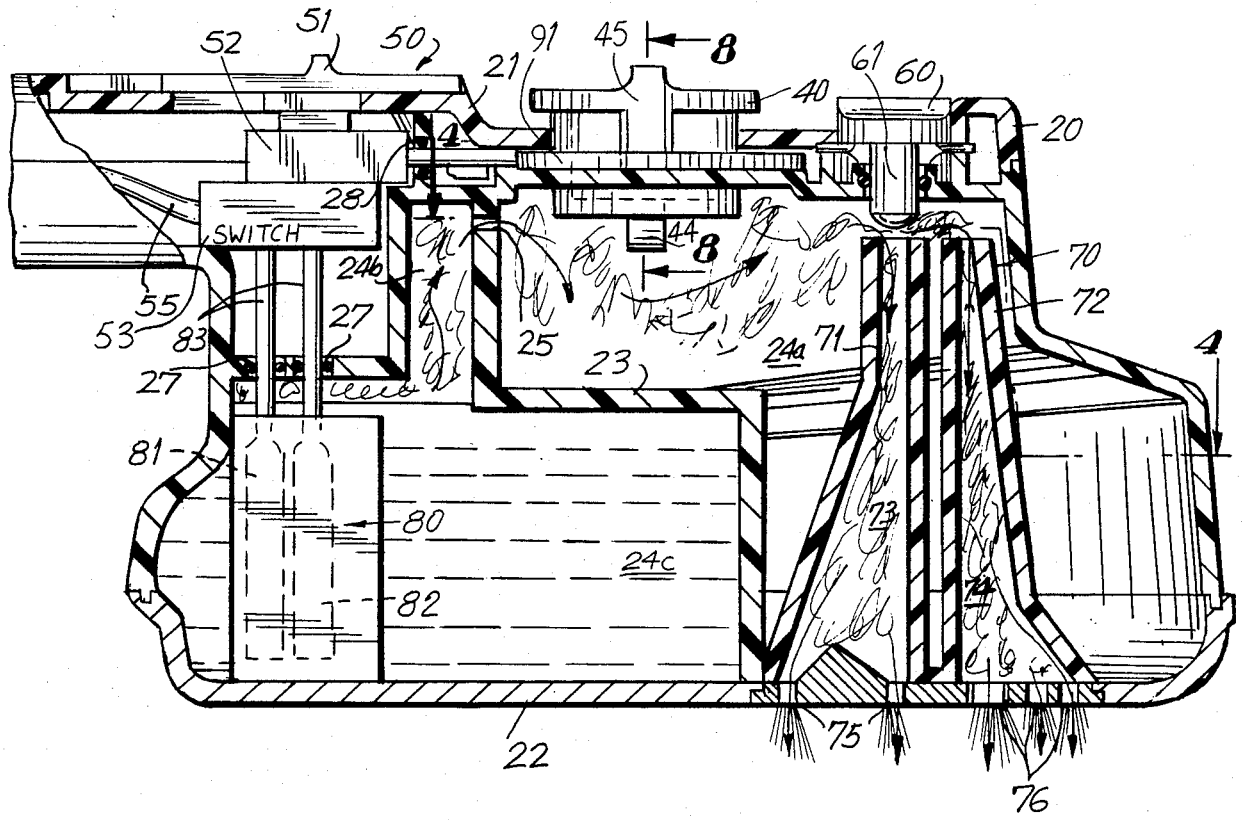
FIG. 3 is a view similar to FIG. 2 but with the closure in place.
Figure 4:
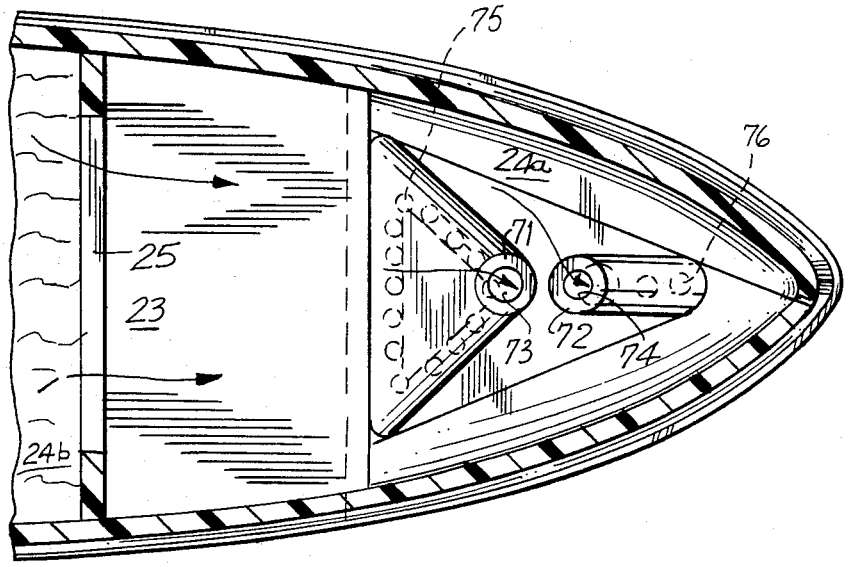
FIG. 4 is a sectional view taken on line 4—4 of FIG. 3.

After the conclusion of the water-transfer operation, the apparatus is returned into its original position, but now, as shown in FIG. 3, the water is in the compartment 24*b* instead of in the compartment 24*a*. Yet, the effect of the partitioning wall 23 will be the same as discussed above, that is, it will avoid the possibility of formation of an electrically conductive path between the compartments 24*a* and 24*b*. At this stage, the steam-producing device 80 is immersed in the body of water accommodated in the compartment 24*b* so that, once energized by electric current supplied thereto through the leads 83, it will heat the water surrounding it and eventually convert it into steam. As a consideration of FIGS. 3 and 4 in conjunction with one another will show, the steam generated in the compartment 24*b* flows through the passage 25 delimited by the partitioning wall 23 into the compartment 24*a* and from there through the flues 73 and 74 of the respective steam stacks 71 and 72 to the respective outlet ports or orifices 75 and 76 to issue from the latter, usually onto the fabric being ironed or steamed. It will be appreciated that the steaming apparatus does not have to be used only in this position during the steam-producing operation; rather, it may also be used in the aforementioned one up-ended position or in any other position in which the steam-producing device 80 is immersed in water. This increases the versatility of the apparatus, in that it can be used for steaming even inclinedly or vertically extending objects, such as curtains, drapes or the like, or even ironing the same (usually in a touch-up ironing operation) so long as an adequate backing or support is provided.

The apparatus of the present invention as described so far can thus be used in many positions without creating the possibility of formation of an electrically conductive path through the water confined in the interior of the housing 20 between the two compartments 24*a* and 24*b*. These positions, incidentally, are those which are most likely to be used by the potential user. However, the user may also attempt to use the apparatus in the other up-ended position in which the compartment 24*b* is situated above the compartment 24*a*. It will be apparent that it would be very disadvantageous if the water already present in the compartment 24*b* were permitted to flow back into the compartment 24*a*, basically for two reasons: first, this water flow could form an electrically conductive path between the two compartments 24*b* and 24*a*, and second, any quantity of water returned into the compartment 24*a* in this manner would reduce the amount of water present in compartment 24*b*, so that it would either have to be transferred back into the compartment 24*b* in a time-consuming water-transfer operation, or the filling operation would have to be repeated earlier than necessary. For this reason, the partitioning wall 23 is so configurated as to form a recess 24*c* which, as shown in FIG. 5, has such a capacity as to receive the entire water contents of the compartment 24*b*, that is, the quantity of water initially transferred into the compartment 24*b* from the compartment 24*a* after the latter has been filled to capacity. It will be appreciated that, when the partitioning wall 23 has the illustrated configuration, there is an overlap between the compartment 24*b* and the recess 24*c*, in that a certain portion of the water contents of the compartment 24*b* is received in the recess 24*c* even in the initial position shown in FIG. 3. Thus, no water will flow back from the compartment 24*b* into the compartment 24*a* in this other up-ended position of FIG. 5, so that the otherwise existing need for replenishing the water contents of the compartment 24*b* after return from this other up-ended position is avoided. The danger of electric current flow through the water is further diminished by the fact that the steam-producing device 80 is so positioned as to be located above the upper level of the body of water contained in the recess 24*c* in this other up-ended position. The cessation of issuance of the steam from the outlet ports 75 and 76 will alert the user to the improper positioning of the apparatus.

FIGS. 6 and 7 illustrate in detail the construction and operation of the closing member 60. It may be seen that the closing member 60 has a coaxial pin-shaped portion 61 which is aligned with the steam stack 71. The closing member 60 also carries two radially outwardly extending projections 62 which are confined between two cam tracks of the housing 20, of which only the lower cam track 63 is shown in FIGS. 6 and 7; however, it will be appreciated that the upper cam track, which is indicated in FIG. 5 at 64, is conformingly or complementarily configurated. The pin-shaped portion 61 is shown to be situated at a distance from the open upper end of the steam stack 71 in FIG. 6. In this position of the closing member 60, fluids can flow into the interior of the steam stack 71 and then flow through the passage 73 to the outlet ports or orifices 75. However, when the closing member 60 is turned into its position illustrated in FIG. 7, the confinement of the projections 62 between the cam tracks 63 and 64 will cause the entire closing member 60 to descend, so that the pin-shaped portion 61 will shut off the open upper end of the steam stack 71 and thus prevent penetration of steam into the interior thereof. It will be appreciated that the amount of steam issued by the apparatus and/or its zone of issuance can be controlled in this manner.

While the above expedients are alone sufficient to eliminate the danger of electric shock to the user of the apparatus, it may be advantageous, and in some countries even required, to build-in an additional safety feature to assure that any damage to the steam-producing device 80 cannot result in an injury to the user, even should the partitioning wall 23 be destroyed, cracked, or otherwise damaged, such as following a fall of the apparatus. This is achieved in the apparatus of the present invention by providing an interlock between the switch 50 and the closure or plug 40, this interlock being constituted by the cam arrangement illustrated in detail in FIGS. 8 and 11. As shown in FIG. 8, the tubular projection 30 which bounds the filling opening 31 has a tubular extension 32 which extends into the interior of the housing 20. The extension merges into a transverse portion 33 which is provided with a rectangular slot 34. The transverse portion 33 has a pair of oppositely inclined cam tracks 36*a*,36*b* at the respective longer sides of the slot 34. A pair of abutments 38*a*,38*b* are provided at the ends of the cam tracks 36*a*,36*b*.

The closure or plug 40 has a cylindrical portion 41 which is received with a small clearance in the filling opening 31 and carries a sealing O-ring 42. The cylindrical portion 41 merges into a stem 43 which is so dimensioned as to pass through the slot 34 and carries at its lower end an enlarged portion 44 of a generally rectangular outline and having transverse dimensions somewhat smaller than the corresponding dimensions of the slot 34. The plug 40 can be turned in the opening 31 between its released position in which the larger dimensions of the enlarged portion 44 and of the slot 34 are coextensive so that the enlarged portion 44 can pass through the slot 34, and its retained position shown in FIG. 8 in which the enlarged portion 44 engages and rides along the cam tracks 36*a*,36*b* behind the transverse portion 33 until the opposite ends of the enlarged portion 44 abut against the stop abutments 38*a*,38*b*. The plug 40 is thus locked in place and extraction thereof from the filling opening 31 is prevented.

The plug 40 further has an engaging portion 45 which passes through a slot 46 of the cover wall 21 and engages in a recess 92 of a ring 91 which forms one part of the cam arrangement or interlocking mechanism 90. The ring 91 is supported in the radial direction on the tubular extension 32, and is confined in the axial direction between the cover wall 21 and the top wall 21*a* which is rigid with the extension 32 and reinforces the housing 20.

As shown in FIG. 9, the ring 91, in addition to having the recess 92, has a radially outwardly raised zone 93 and a radially recessed zone 94 which is circumferentially delimited by stop surfaces 95 and 96 that cooperate with a stationary abutment 97 to delimit the range of angular displacement of the ring 91. The cam arrangement 90 further includes a pawl-like member 98 which is mounted on the housing 20 for pivoting about an axis of a pivot 99. The pawl-like member 98 and the raised and recessed zones 93 and 94 cooperate with the operating element 54 of the switch 50 in a manner which will become apparent from a consideration of FIGS. 10 and 11.

In FIG. 10, the ring 91 is shown in its position assumed when the plug 40 is removed from the filling opening 31 and maintained until turning of the plug 40 into its retained position begins. In this position of the ring 91, the raised zone 93 is aligned with the path of movement of the operating element 54, and the pawl-like member 98 is interposed between the raised zone 93 and the element 54, which is then in its position corresponding to the off opposition of the switch 50. It may be seen that, if it were attempted to move the operating element 54 toward its on position, the operating element 54 would first have to push the pawl-like member 98 aside, but the raised zone 93 prevents this, so that the operating element 54 and thus the switch cannot be moved into its on position.

The situation is quite different once the ring 91 has been turned by means of the projection 45 of the plug 40 into its position illustrated in FIG. 11 which corresponds to the retained position of the plug 40. In this case, it is the recessed zone 94 of the ring 91 which is situated in the trajectory of movement of the operating element 54 of the switch 50 so that, when the switch is moved to its on position, the operating element 54 will pivot the pawl-like member 98 into the recessed zone 94 of the ring 91 and thus render it possible for the switch 50 to be moved all the way into its on position. In this on position, the operating element 54 may but need not come into contact with the ring 91. Hence, it may be seen that the ring 91 and the pawl-like member 98 cooperate to constitute a lock for the switch 50 which prevents the latter to be moved into its on position unless the plug 40 assumes its retained position.

Conversely, the operating element 54 acts as a lock for the plug 40, preventing its turning movement toward its released position so long as the switch assumes its on position. This is so because, in its on position, the operating element 54 extends into the trajectory of turning movement of the raised zone 93, so that, if an attempt is made to turn the plug 40 toward its released position, the raised zone 93 will merely pivot the pawl-like member 98 into contact with the operating element 54, after which the operating element 54 will prevent any further pivoting of the pawl-like member 98 in this direction. It is only after the operating element 54 has been withdrawn into its off position that the raised portion 93 can pivot the pawl-like member out of its trajectory of movement and thus continue its movement toward its unlocking position corresponding to the released position of the plug 40.

What is claimed as new and desired to be protected by Letters Patent is set forth in the appended claims:

1. A hand-held, steam-producing apparatus, comprising:

(a) a hollow housing including a top wall, a bottom wall and a pair of side walls together bounding an interior, said housing having a partitioning wall extending between the top and bottom walls and subdividing the interior into two compartments, said top wall having a water-filling openable inlet which, when opened, provides fluid communication with one of the compartments, said bottom wall having a steam outlet port in fluid communication with said one compartment, said partitioning wall having an open communicating passage extending between the compartments for providing fluid communication therebetween;

(b) a hollow tubular steam stack in said one compartment and extending from the steam outlet port in the bottom wall towards the top wall and terminating short of the latter to form a steam inlet port at an elevation, as considered with respect to the bottom wall, which is lower than that of the communicating passage of the partitioning wall;

(c) a handle on the housing for permitting a user to manipulate the apparatus among (i) a filling position in which the top wall is situated above the bottom wall to permit water to enter said one compartment via the opened water-filling inlet of the top wall, (ii) a transfer position in which said one compartment is situated above the other of the compartments to permit the water received in said one compartment to be transferred to said other compartment via the open communicating passage, and (iii) an up-ended position in which said other compartment is situated above said one compartment;

(d) a pair of spaced-apart, energizable electrodes located in said other compartment, and means for selectively energizing the electrodes upon application of different electric potentials thereto to electrolytically generate steam by the passage of electric current between the energized electrodes and through the water transferred to said other compartment; and (e) means for preventing the formation of an electrically conductive path through water between the energized electrodes and the user in the filling, transfer and up-ended positions, said preventing means including a water-inpervious, electrically-insulating section of the partitioning wall, said section extending away from the electrodes and bounding a recess in said other compartment to constitute a part thereof, said recess having a capacity sufficient to retentively receive substantially the entire water contents of said other compartment in the up-ended position, and to maintain said entire water contents out of electrolytic contact with the energized electrodes in the up-ended position.

2. The apparatus as defined in claim 1, wherein said partitioning wall section is generally L-shaped in cross-section and has one wall part extending away from the electrodes in a direction generally parallel to the bottom wall, and another wall part extending in a direction generally normally to the bottom wall.

3. The apparatus as defined in claim 2, wherein said other wall part is located away from the electrodes at a distance sufficient to maintain the level of said entire water contents received in said recess in the up-ended position below the electrodes.

4. The apparatus as defined in claim 1, wherein said housing further includes a cover wall located above the top wall; and further comprising a closure mounted in said water-filling inlet for movement between a closed and an open position in which the closure closes and opens the inlet, respectively; and wherein said energizing means includes an electrical switch mounted on the cover wall at a predetermined distance from the inlet and having an operating member movable between an off and an on position for selectively energizing the electrodes; and wherein said preventing means includes means for preventing movement of said operating member into said on position thereof when the closure is in its open position.

5. The apparatus as defined in claim 4, wherein the closure includes a removable plug turnable in the inlet between retained and released positions and removable from the filling inlet in the released position for movement into the open position remote from the filling inlet; and wherein said preventing means includes a cam arrangement mounted at the filling inlet for movement, in response to the turning of the plug from the retained to the released position, from an unlocking position in which the cam arrangement permits, into a locking position in which the cam arrangement prevents, movement of said operating member of said switch from said off into said on position thereof.

6. The apparatus as defined in claim 5, wherein said preventing means further includes complementary male and female entraining formations on said plug and said cam arrangement which cooperate with one another for entraining an entrainable part of said cam arrangement for joint turning with said plug to said locking or unlocking positions, respectively.

7. The apparatus as defined in claim 6, wherein said top wall includes an annular support portion for said entrainable part extending around the filling inlet; and wherein said entrainable part is a ring turnably mounted on said support portion and having a radially raised circumferential zone aligned in said locking position, and a radially recessed circumferential zone aligned in said unlocking position, of said cam arrangement with the path of movement of said operating member of said switch.

8. The apparatus as defined in claim 7, wherein said cam arrangement further includes a pawl-like intermediate member mounted on the top wall of the housing between the switch and the filling inlet for pivoting about a pivot axis and having a portion remote from said pivot axis and extending into the path of movement of the operating member and adjacent the trajectory of turning movement of said ring so as to constitute an abutment for the operating member when juxtaposed with said radially raised circumferential zone of said ring in said locking position, and to yield into said radially recessed circumferential zone of said ring in response to the movement of the operating member toward its on position in said unlocking position, of said ring.

9. The apparatus as defined in claim 8, wherein said portion of said intermediate member completely yields out of the path of movement of the operating member as the latter approaches the on position thereof to be confined between said raised zone of said ring and the operating member of the switch and thus to prevent turning of said ring and thus of the closure toward said unlocking and released positions thereof while the operating member is in its on position.

10. The apparatus as defined in claim 9, wherein said portion of said intermediate member is so positioned relative to said raised zone as to be pivoted by the latter out of said recessed zone of said ring in said off position of the operating member and during the turning of said ring toward its unlocking position.

11. The apparatus as defined in claim 10, wherein said support portion retains said ring between itself and the cover wall of the housing inwardly of the latter; and wherein said operating member of the switch is also at least partially situated inwardly of the cover wall of the housing.

12. The apparatus as defined in claim 4, wherein the cover wall of the housing has a through aperture through which the switch passes between the exterior and the interior of the housing; wherein the switch has an actuating element situated at the exterior of the housing and connected to the operating member for joint movement therewith between the on and off positions; wherein the apparatus further includes electric leads connecting the electrodes to the switch; and wherein said preventing means further includes a compartmentalizing wall bounding an additional compartment between itself and the housing at the cover wall above the other compartment and around the aperture for the switch, said compartmentalizing wall being impermeable to water and having respective openings for the passage of the operating member and the electric leads therethrough, said preventing means further including sealing means for sealing the operating member and the electric leads in the respective openings.

* * * * *